US008453543B2

(12) United States Patent
Floyd

(10) Patent No.: US 8,453,543 B2
(45) Date of Patent: Jun. 4, 2013

(54) TOOL

(76) Inventor: Christopher Sean Floyd, Charlottesville, VA (US)

( * ) Notice: Subject to any disclaimer, the term of this patent is extended or adjusted under 35 U.S.C. 154(b) by 339 days.

(21) Appl. No.: 12/887,828

(22) Filed: Sep. 22, 2010

(65) Prior Publication Data

US 2011/0088522 A1 Apr. 21, 2011

Related U.S. Application Data

(60) Provisional application No. 61/253,179, filed on Oct. 20, 2009.

(51) Int. Cl.
*B25G 1/08* (2006.01)
*B25F 1/02* (2006.01)
*B25B 15/02* (2006.01)

(52) U.S. Cl.
USPC ..... 81/177.4; 81/450; 81/177.6; 81/177.7

(58) Field of Classification Search
USPC ..... 81/177.4, 177.6, 177.7, 177.85, 436–438, 81/439, 450; 7/125, 127, 128
See application file for complete search history.

(56) References Cited

U.S. PATENT DOCUMENTS

| | | | | |
|---|---|---|---|---|
| D218,140 | S * | 7/1970 | Johannsen | D8/29 |
| 4,648,145 | A | 3/1987 | Miceli | |
| 5,566,596 | A | 10/1996 | Lin | |
| 6,023,805 | A * | 2/2000 | Lin | 7/128 |
| 6,640,675 | B1 | 11/2003 | Chuang | |
| 6,662,688 | B1 * | 12/2003 | Avery | 81/177.7 |
| 6,779,212 | B2 * | 8/2004 | Anderson et al. | 81/438 |
| 6,976,410 | B2 | 12/2005 | Anderson et al. | |
| 7,216,569 | B2 | 5/2007 | Abdelgany | |
| 7,380,660 | B2 | 6/2008 | Lin | |
| 7,571,517 | B2 * | 8/2009 | Smith et al. | 81/177.7 |

* cited by examiner

*Primary Examiner* — Hadi Shakeri
(74) *Attorney, Agent, or Firm* — Thomas & Karceski, PC

(57) ABSTRACT

A tool includes a driving member with a protrusion. A shaft is removably connectable to the protrusion. The shaft includes a bit driving segment for retention of a bit therein. A handle includes a first handle portion and a second handle portion, both of which are pivotally connected to the driving member such that the first and second handle portions at least partially encompass the shaft when in a closed position. A bit retention member is disposed in at least one of the handle portions to retain the bit therein. The bit is insertable into the bit driving segment. At least one notch is fashioned into at least one of the handle portions. The notch is in register with the at least one bit retention member, permitting a user to access the at least one bit retained therein.

20 Claims, 9 Drawing Sheets

TOOL

CROSS-REFERENCE TO RELATED APPLICATION(S)

This is a United States Non-Provisional Patent Application that relies for priority on U.S. Provisional Patent Application Ser. No. 61/253,179, which was filed on Oct. 20, 2009, the contents of which are incorporated herein by reference.

FIELD OF THE INVENTION

The present invention concerns a portable tool. More specifically, the present invention concerns a compact screwdriver with stored, interchangeable bits to engage the head of a complimentary fastener or the like.

DESCRIPTION OF THE RELATED ART

There are numerous examples of screwdrivers known in the art. The most basic involves a handle molded around a shaft, with the driving end of the screwdriver integrally formed with and disposed at the tip of the shaft.

Multi-bit screwdrivers also are known in the art. Such multi-bit screwdrivers typically have a fixed shaft with a bit receiver at one end and a handle at the other. The handle typically contains the bits.

As should be apparent to those skilled in the art, the way in which the handles hold the bits varies from design to design. Some handles have recesses on the outer portion of the handle where the bits are stored. In one known design, the handle is manufactured as a single molded body with the bit storage recesses being included as part of the molded body. Here, the bits are typically accessible from locations or positions around the shaft of the screwdriver, which is fixedly disposed within the handle body.

A second common form of multi-bit screwdriver includes a fixed shaft with a bit receiver at one end. A hollow plastic handle is attached at the other end of the shaft and houses the bits in a storage portion within the handle. This type of storage handle usually consists of a molded plastic body that has an array of bit storage places inside of it. A plastic cover usually is screwed or snaps on to the handle.

Both of the typical multi-bit designs exhibit inherent disadvantages when being evaluated as pocket tools. One disadvantage lies in the length of the fixed shaft. As should be apparent, with a long, fixed shaft, there is no way to shorten the shaft. The length of the shaft makes the tool impractical as a pocket tool, as a general rule. A second disadvantage lies in the design and construction of the handle, which tends to be round in shape and very thick in cross-sectional dimension. A bulbous or oversized handle renders this type of design impractical as a pocket tool.

Another common form of a multi bit screw driver includes a hollow shaft with two or more double-ended tool bits disposed inside of the hollow shaft. In one known design, each of the two tool bits protrudes from the either end of the shaft. The tool bits can be removed and reversed in a bit receiver at each end, thereby offering a greater variety of bits for engagement with a fastener, such as a screw. Either end of the shaft is insertable into a handle, which is separate from the shaft, to form a complete screwdriver. This particular screwdriver also presents a number of disadvantages when it is evaluated as a pocket tool. The first disadvantage is its size. The long shaft and the thick handle make it impractical as a pocket tool. Secondly, screwdrivers such as this do not accept standard bits and are limited to only the four types of bit heads that are at either end of the two double-ended tool bits.

Another multi-bit screwdriver that is available consists of a folding pair of pliers with a bit receiver attached to an array of other tools in the pliers' handles. The tool bits are usually stored separately in a rubber or plastic bit holder. This tool unfortunately suffers from a very short shaft, which makes it impractical in many circumstances. Moreover, the tool bit storage device is not actually part of the tool itself, which requires separate handling of the components of the tool, making it impractical as a pocket device.

Another multi-bit screw driver that has recently become available consists of a folding knife with a fold out bit driver. The bits are stored on the sides of the knife. One downside with this design is that the shaft is short. In addition, at least with respect to currently-available models, the bit driver does not accept standard tool bits.

There are still further types of multi-bit screwdrivers that are available to consumers. For example, multi-bit screwdriver sets are available commercially. These sets include a variety of bit drivers with a varied array of tool bits, all housed in a separate case or in separate cases. The prospect of using screwdriver sets as a pocket tool presents some serious impracticalities. First, the sizes of most such screwdriver sets make them undesirable or even impossible to carry in a person's pocket, as they are usually housed in briefcase style carrying cases. Second, the complexity of these kits and the time it takes to employ them also makes them impractical as pocket tools.

Reference is now made to U.S. Pat. No. 7,380,660 (hereinafter the '660 patent), which describes a tool handle type tool box. In the '660 patent, a handle is formed by first and second cover shells 10, 20. (The '660 patent at col. 1, lines 46-48.) A tool bit socket 12 is pivotally mounted in a groove 11. (The '660 patent at col. 1, lines 51-52.) A tool bit adapter 24, which holds a tool bit 25, may be inserted into one of two coupling holes 17 or a coupling hole 18. (The '660 patent at col. 2, lines 18-20.) A tool bit tray 22 within the handle holds the tool bits 25. (The '660 patent at col. 2, lines 10-11.) In connection with the discussion above, it is noted that the handle presents a significant cross-section, which might dissuade a typical user from considering the device as a pocket tool.

U.S. Pat. No. 7,216,569 (hereinafter "the '569 patent") describes a screwdriver handle. The handle 5 includes an elongated base portion 10. (The '569 patent at col. 3, lines 11-12.) A pair of retractable arms 12 may be extended from the handle 5. (The '569 patent at col. 3, lines 38-41.) The arms 12 permit a user to apply additional torque to the handle 5 while rotating the screwdriver. (The '569 patent at col. 3, lines 1-4.) As described above, the handle 5 presents a large enough cross-section that it unlikely to be considered as a suitable pocket tool.

U.S. Pat. No. 6,976,410 (hereinafter "the '410 patent") describes a tool bit drive adapter. The adapter mates with a foldable pair of pliers to provide a driver for various screwdriver bits. (The '410 patent at col. 1, lines 14-17.) The adapter 20, which is illustrated in FIG. 1, attaches to a foldable pair of pliers, such as the Leatherman® Pocket Survival Tool™ 46. (The '410 patent at col. 4, lines 15-18.) The adapter provides a tool bit-engaging member 22 that may receive a screwdriver bit. (The '410 patent at col. 3, lines 41-47.) As an adapter 20, the device necessarily presents a challenge to a person in that the person is required to carry both the tool 46 and the adapter 20 when a screwdriver function is desired.

U.S. Pat. No. 6,640,675 (hereinafter "the '675 patent") describes a tool kit for bicycles. The tool kit includes a body 10 with an internal chamber 16 and a socket 20. (The '675 patent at col. 2, lines 17-18 and 23.) A carrier 30, which is concealed in the chamber 16 when closed, defines a plurality of chambers 35 for receiving tool bits 36. (The '675 patent at col. 2, lines 41-42.) As with the '660 patent, it is contemplated that at least the size of the handle might dissuade a person from considering the device as a pocket tool.

U.S. Pat. No. 5,566,596 (hereinafter "the '596 patent") describes a hand tool assembly with a casing 1, a cover 30, a shank 50, and a set of bits 40. (The '596 patent at col. 2, lines 17-20.) As illustrated in FIG. 4, the bits 40 and the shank 50 may be stored inside of the casing 1 when not in use. As should be apparent, however, the bulbous shape and size of the tool likely would discourage persons from considering the device to be pocket tool.

U.S. Pat. No. 4,648,145 (hereinafter "the '145 patent") describes a folding pocket tool and knife. The tool includes paired handles 34, 36 that cover the knife blade 20 when the knife blade is not exposed. (The '145 patent at col. 2, lines 60-63.) The butt end of the knife blade 20 includes three screwdriver blades 80, 82, 84 disposed on it. (The '145 patent at col. 3, lines 52-55.) A punch 98 also is provided with the tool. (The '145 patent at col. 12-14.) With this device, the screwdriver function is secondary to the utility of the device as a knife. As a result, a person would not necessarily consider this device to be a suitable pocket screwdriver.

It is noted that the disadvantages discussed above are intended merely to be exemplary of aspects of the prior art that are less than advantageous with respect to the prior art.

In view of the foregoing, it is noted that the prior art does not provide a compact, pocket screwdriver with multiple tool bits.

SUMMARY OF THE INVENTION

It is, therefore, at least one aspect of the present invention to address one or more of the deficiencies noted above with respect to the prior art.

In one embodiment, a tool is provided with a driving member having a protrusion and a shaft removably connectable to the protrusion. The shaft includes at least a bit driving segment for retention of a bit therein. The bit is engageable at least with a complimentary fastener. The tool also has a handle with a first handle portion and a second handle portion. The first and second handle portions are pivotally connected to the driving member such that the first and second handle portions at least partially encompass the shaft when in a closed position. The first and second handle portions abut one another when in an opened position, thereby presenting a unified handle for driving the shaft. The tool also includes at least one bit retention member disposed in at least one of the handle portions. The bit retention member retains at least one bit therein, the bit being insertable into the bit driving segment. The tool also has at least one notch fashioned into at least one of the handle portions, the at least one notch being in register with the at least one bit retention member, permitting a user to access the at least one bit retained therein.

In one contemplated embodiment, the driving member of the tool includes a T-shaped body with a first arm, a second arm opposing the first arm, and the protrusion disposed therebetween and extending perpendicularly therefrom.

In another embodiment, the protrusion includes a retention member therein that comprises a ball bearing biased in a distended position by a spring.

In still another embodiment, the driving member further includes a first opening in the first arm, a first pin disposed within the first opening to pivotally support the first handle portion on the first arm, a second opening in the second arm, and a second pin disposed within the second opening to pivotally support the second handle portion of the second arm.

It is also contemplated that the tool of the present invention includes a shaft that has at least one attachment segment that removably engages with the protrusion, and at least one adjustment segment that permits the shaft to be angled with respect to an axis of the protrusion. The bit driving segment removably connects to the at least one adjustment segment.

One embodiment of the tool contemplates the inclusion of an extension segment disposable between the at least one adjustment segment and the bit driving segment. The extension segment extends a length of the shaft.

It is also contemplated that the tool includes a first magnet disposed within the at least one extension segment to provide a magnetic attraction between the at least one extension segment and the bit driving segment.

Another embodiment of the tool includes a second magnet disposed within the bit driving segment to provide a magnetic force at least between the bit driving segment and the bit.

In still another contemplated embodiment of the tool, the first and second handle portions have a top wall, a lateral wall, and a bottom wall connected to one another to form a U-shaped body. The at least one notch is fashioned into the top wall. The first handle portion is a mirror image of the second handle portion.

The bit retention member of the tool may include a U-shaped body that is insertable into the U-shaped body of at least one of the first and second handle portions, the U-shaped body of the at least one bit retention member comprising a base, a first wall, and a second wall that form a channel within the U-shaped body.

In one contemplated embodiment of the tool, the first wall may include at least one barb to assist with retaining the at least one bit retention member in at least one of the first and second handle portions and the second wall comprises at least one finger, with an angled tip, and a tab extending into the channel.

Additionally, the tab, the at least one finger, and an interior surface of the top wall of at least one of the first and second handle portions cooperate to retain the bit therein.

In a further configuration, an axis of the at least one bit, when stored in the at least one bit retention member, is parallel with an axis of the shaft when the first and second handle portions are in the closed position.

In another configuration, the axis of the at least one bit, when stored in the at least one bit retention member, is parallel with an axis of the shaft when the first and second handle portions are in the opened position.

One further embodiment of the tool contemplates that the tool includes a driving member with a protrusion and a shaft removably connectable to the protrusion. The shaft includes at least a bit driving segment for retention of a bit therein, the bit being engageable at least with a complimentary fastener. The tool also includes a handle with a first handle portion and a second handle portion. The first and second handle portions are pivotally connected to the driving member such that the first and second handle portions at least partially encompass the shaft when in a closed position. The first and second handle portions abut one another when in an opened position, thereby presenting a unified handle for driving the shaft. The tool also includes at least one bit retention member disposed in at least one of the handle portions. The bit retention member retains at least one bit therein, the bit being insertable into the bit driving segment. An axis of the at least one bit, when stored in the at least one bit retention member, is parallel with an axis of the shaft when the first and second handle portions are in the closed position.

Other aspects of the invention will be apparent to those skilled in the art from the discussion that follows.

BRIEF DESCRIPTION OF THE DRAWINGS

The present invention will now be described in connection with various figures, in which.

DETAILED DESCRIPTION OF EMBODIMENT(S) OF THE INVENTION

While the present invention is described in connection with one or more embodiments, it should be understood that the present invention is not intended to be limited to the embodiments described. To the contrary, as should be apparent to those skilled in the art, variations and equivalents of the embodiment(s) described will become apparent from the description that follows and from the drawings appended hereto. The present invention is intended to encompass those variations and equivalents.

Figure 1:
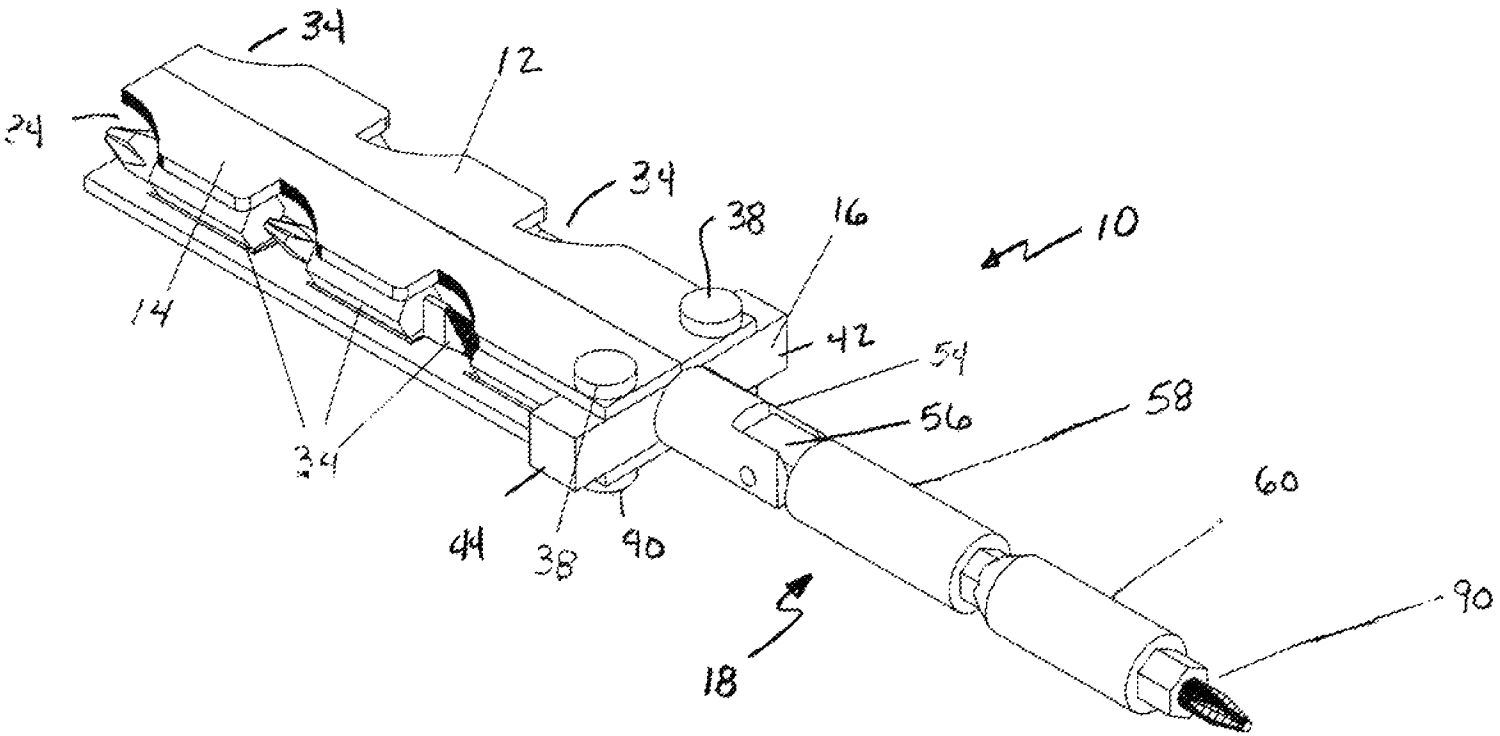
FIG. 1 is a perspective, top view of a first embodiment of a tool according to the present invention, shown in an unfolded state, consistent with the use of the invention.

With reference to FIG. 1, the tool 10 of the present invention is shown from a perspective, top view. As depicted, the tool 10 is shown in an unfolded state, ready for use. As its primary components, the tool 10 includes two handle portions 12, 14 that are pivotally connected to a T-shaped driving member 16. An adjustable shaft 18 also is connected to the driving member 16.

Figure 7:
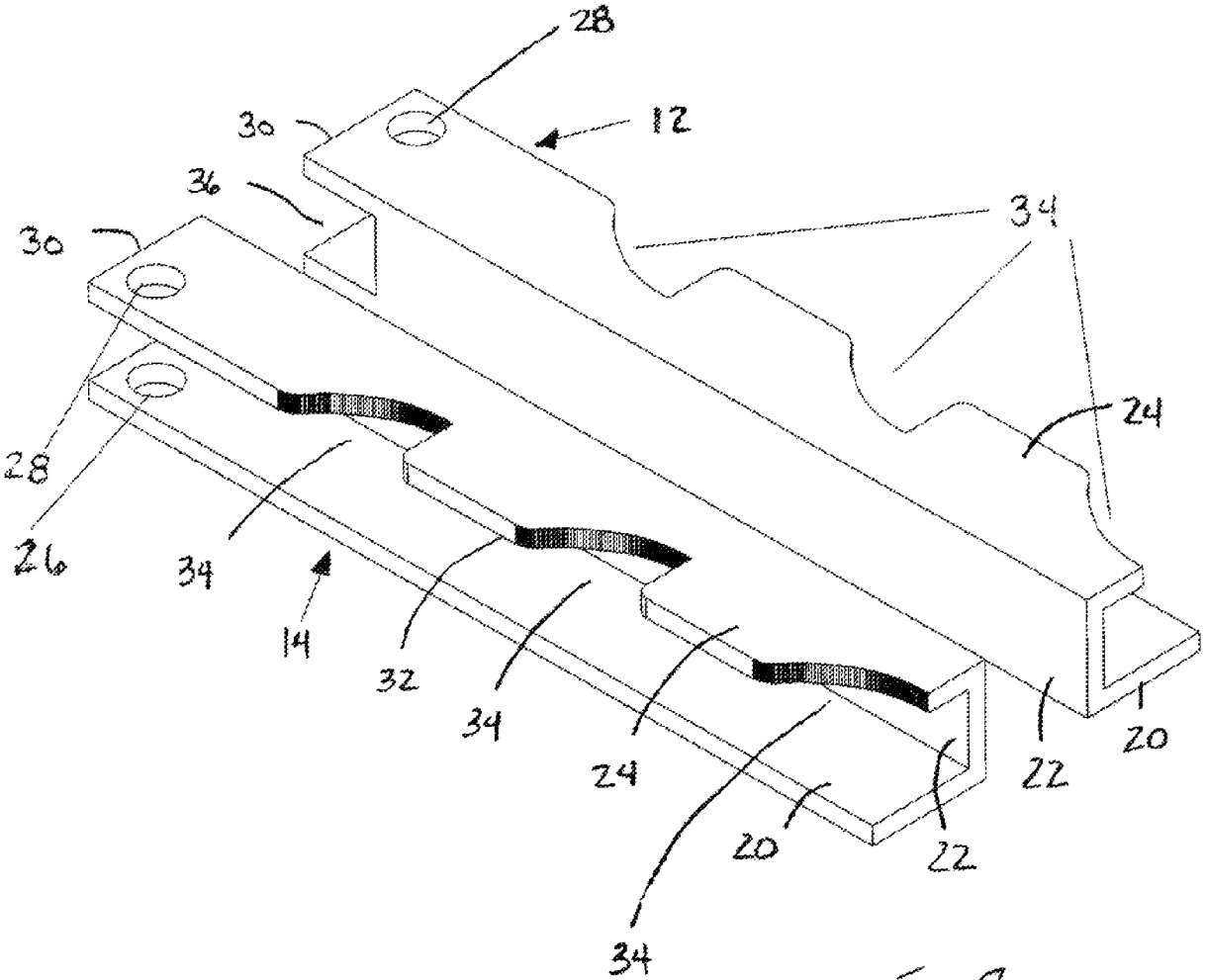
FIG. 7 is a perspective, top view of the handle portion of the tool illustrated in FIG. 1.

The handle portions 12, 14 of the tool 10 are depicted in enlarged detail in FIG. 7. The handle portions 12, 14 are contemplated to be made from a metal material, such as iron, steel, stainless steel, aluminum, titanium, or the like. It is also contemplated that any metal or metal alloy may be employed for the handle portions 12, 14 without departing from the scope of the present invention. It is noted that the handle portions 12, 14 need not be made from metal. Instead, they may be fashioned from a suitable composite material (i.e., carbon fiber or other laminate) or from a thermoplastic material, among others. Nylon also may be employed. As should be apparent to those skilled in the art, the exact composition of the handle portions 12, 14 is not critical to the construction and operation of the tool 10 of the present invention.

As is apparent in FIGS. 1 and 7, each of the handle portions 12, 14 are mirror images of one another. The handle portions 12, 14 are shown as rectangular, U-shaped members with bottom sides 20, lateral sides 22, and top sides 24. Being U-shaped components, one side of each of the handle portions 12, 14 is not closed with a wall or other structure, but remains open.

Openings 26, 28 are bored through the bottom and top sides 20, 24 of the handle portions 12, 14 at top ends 30 thereof. The open edges 32 of the top surfaces 24 of the handle portions 12, 14 are each provided with three fin-shaped notches 34 therein. The notches 34 extend inwardly, respectively, from exterior edges 32 of the handle portions 12, 14. The purpose of the fin-shaped notches 34 is described in greater detail below.

As is apparent from FIGS. 1 and 7, the openings 26, 28 extend through the top ends 30 of the handle portions 12, 14 such that they are offset from a centerline of the handle portions 12, 14. In addition, the top ends 30 of the lateral sides 22 of the handle portions 12, 14 include U-shaped cutouts 36. The offset openings 26, 28 cooperate with the cutouts 36 to permit the handle portions to rotate from the closed orientation illustrated in FIG. 3 to the opened orientation illustrated in FIG. 1. Among other aspects, the offsets of the openings 26, 28 permit the lateral sides 22 of the handle portions 12, 14 to abut against one another in the opened orientation, thereby presenting a compact handle for operation of the tool 10.

Figure 5:
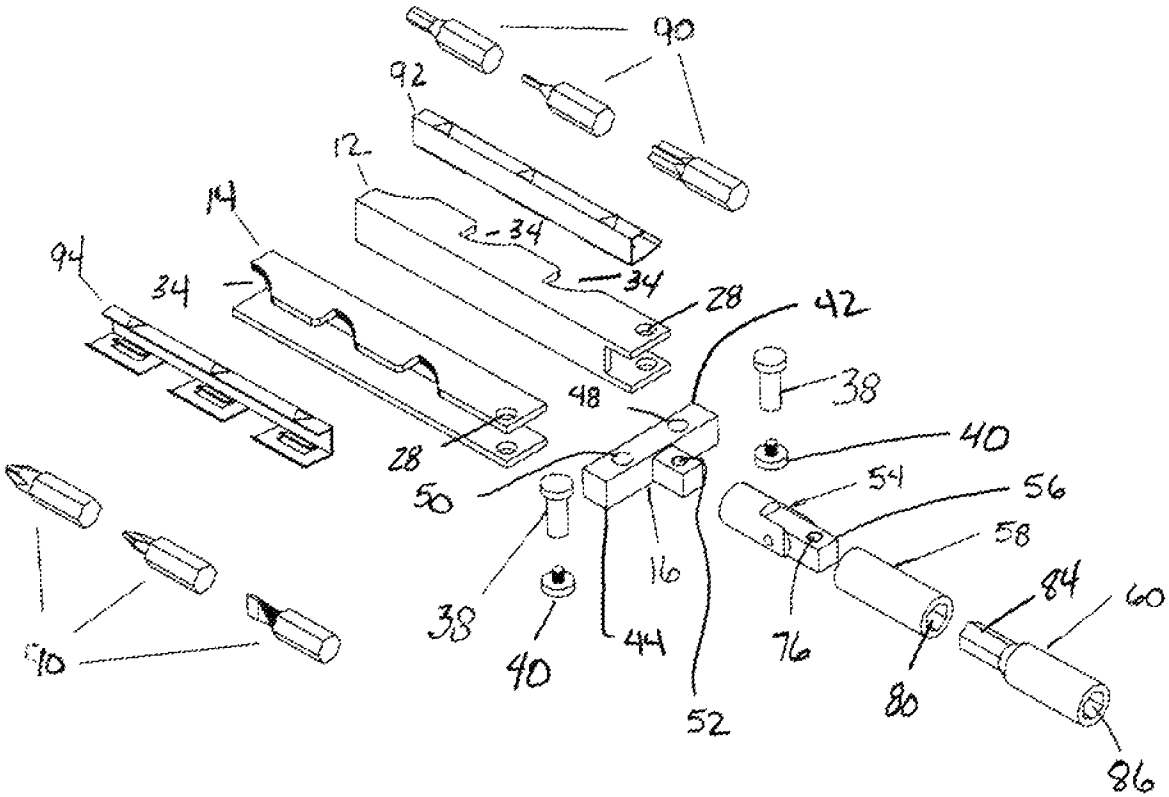
FIG. 5 is a perspective, top view of the tool illustrated in FIG. 1, shown in an exploded state.

As should be apparent from FIGS. 1 and 5, the openings 26, 28 receive pins 38 so that the handle portions 12, 14 may pivot therearound. The pins 38 are retained within the openings 26, 28 by end caps 40, which are also illustrated in FIG. 5. The pins 38 permit the handle portions 12, 14 to rotate from the closed orientation to the opened orientation.

In the embodiment illustrated, it is contemplated that the caps 40 are removable from the pins 38. This permits disassembly of the tool 10, which may be desired so that the use may clean the various components of the tool 10, for example. As should be apparent to those skilled in the art, the pins 38 need not be separable from the caps 40 for operation of the present invention. To the contrary, the caps 40 may be rivets that non-removably secure the pins 38 to the tool 10. In this contemplated embodiment, the caps 40 may be riveted to the pins 38 so that they cannot be removed from the pins 38.

Figure 6:
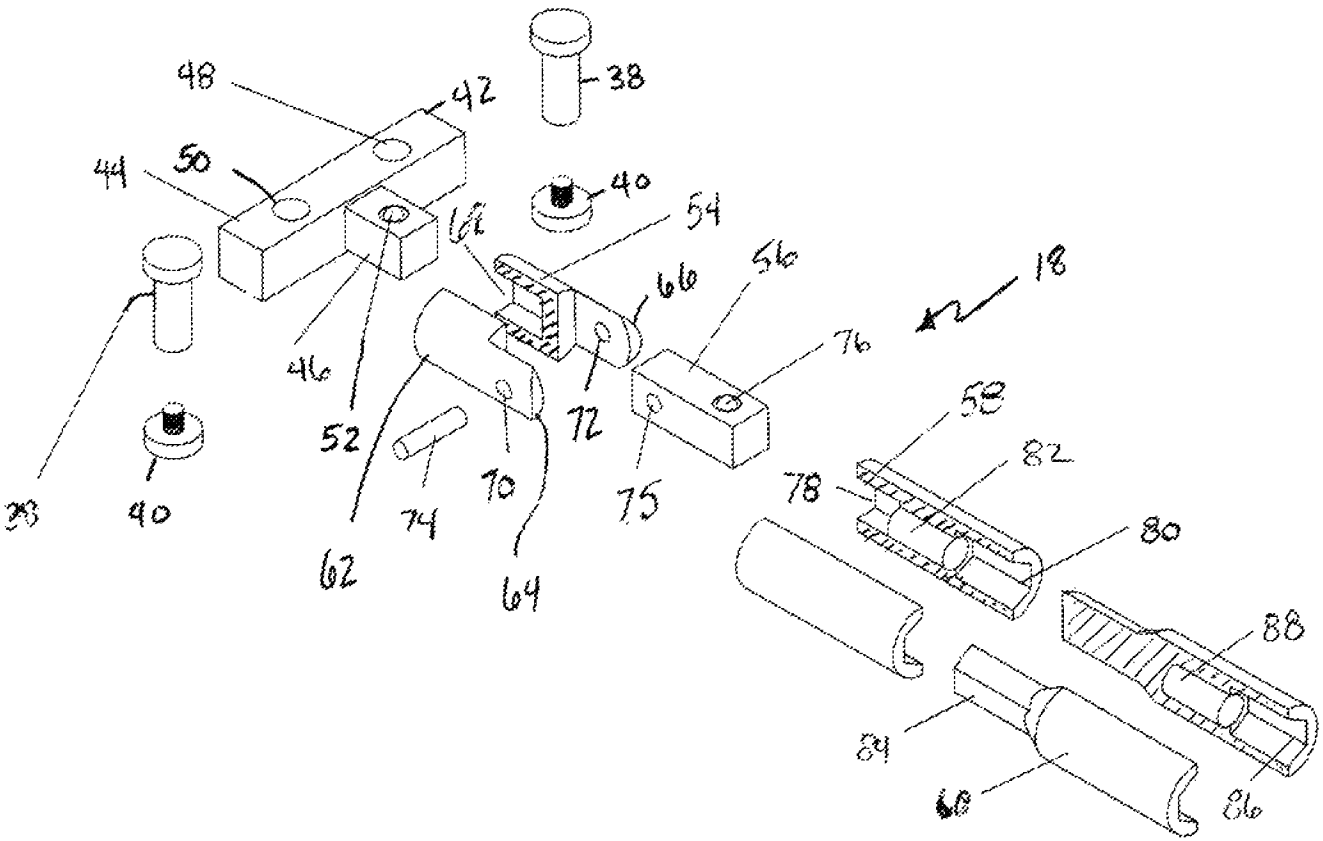
FIG. 6 is a perspective, top view of the driving assembly portion of the tool illustrated in FIG. 1.

The driving member 16, which is illustrated in enlarged detail in FIG. 6, is essentially a T-shaped member that is constructed from a metal material such as iron, steel, stainless steel, aluminum, titanium, or the like. It is also contemplated that any metal or metal alloy may be employed for the driving member 16 without departing from the scope of the present invention. As should be apparent to those skilled in the art, the driving member 16 need not be made from metal. Instead, the driving member 16 may be fashioned from a suitable composite material (i.e., carbon fiber or other laminate) or from a thermoplastic material, among others. Nylon also may be used. As should be apparent to those skilled in the art, the exact composition of the driving member 16 is not critical to the construction and operation of the tool 10 of the present invention.

The T-shaped driving member 16 includes two opposed arms 42, 44 and a central protrusion 46. The two opposed arms 42, 44 and the central protrusion 46 are contemplated to be molded as a unitary structure (i.e., a single piece construction). They may also be machined from a single block of material, for example. It should be understood, however, that the components could be manufactured separately and assembled after manufacture. In addition, while it is contemplated that the central protrusion 46 is manufactured as an integral part of the driving member 16, the central protrusion 46 may be removable to be replaceable with a different connector, as desired.

The details of the driving member 16 are illustrated in expanded detail in FIG. 6.

As is apparent from in FIG. 6, the driving member 16 includes two openings 48, 50, which receive the pins 38 so that the handle portions 12, 14 are able to rotate with respect thereto. The central protrusion 46 includes a retention member 52 that removably engages the shaft 18, which is described in greater detail below.

The retention member 52 is contemplated to combine a ball bearing and spring within the central protrusion 46. As should be appreciated by those skilled in the art, the spring biases the ball bearing in an extended position. When the shaft 18 is inserted over the central protrusion 46, the ball bearing retracts so that the shaft 18 may be fully inserted onto the central shaft 46. The spring then pushes the ball bearing outwardly so that the ball bearing engages a detent (or groove) within the shaft 18 to retain the shaft 18 thereon. The shaft 18 may be removed by applying a force away from the central protrusion 46 to overcome the bias pressure applied to the ball bearing by the spring. As should be apparent, the illustrated retention member 52 is not required to practice the present invention. To the contrary, other retention devices may be employed without departing from the scope of the present invention.

In the embodiment illustrated in FIG. 6, the shaft 18 includes several sections. The first section is an attachment segment 54. The second section is an adjustment segment 56, which is pivotally connected to the attachment segment 54. The third section is an extension segment 58, which removably attaches to the adjustment segment 56. The fourth section is a bit driver segment 60 that removably attaches to the extension segment 58. Together, the four segments form the shaft 18, as discussed herein.

The attachment segment 54 includes a cylindrically-shaped body 62 with two arms 64, 66 attached thereto. The body 62 includes a receiving opening 68 to receive the central protrusion 46 therein. The arms 64, 66 define a space therebetween that receives one end of the adjustment segment 56. The arms 64, 66 each include openings 70, 72 to receive a pin 74 therein. The pin 74 is inserted through the openings 70, 72 and is also received within an opening 75 within the adjustment segment 56. The pin 74 permits the adjustment segment 56 to rotate with respect to the arms 64, 66 and the attachment segment 54. As a result of this construction, the adjustment segment 56 (and the shaft 18) may be positioned in any of a number of angular positions with respect to the handle portions 12, 14. This permits the user to access fasteners in different orientations and with different accessibilities.

While it is contemplated that the adjustment segment 56 will be held between the arms 64, 66 in a manner that provides at least some frictional engagement between the attachment segment 54 and the adjustment segment 56, this is not required for operation of the tool 10 of the present invention. It is contemplated that frictional engagement will assist the user to utilize the tool 10. Alternatively, the interior surfaces of the arms 64, 66 and the exterior surface of the adjustment segment 56 may be provided with knurls or teeth to assist with frictional engagement therebetween. Knurls, teeth, or other friction-generating means are not required to practice the present invention.

Figure 2:
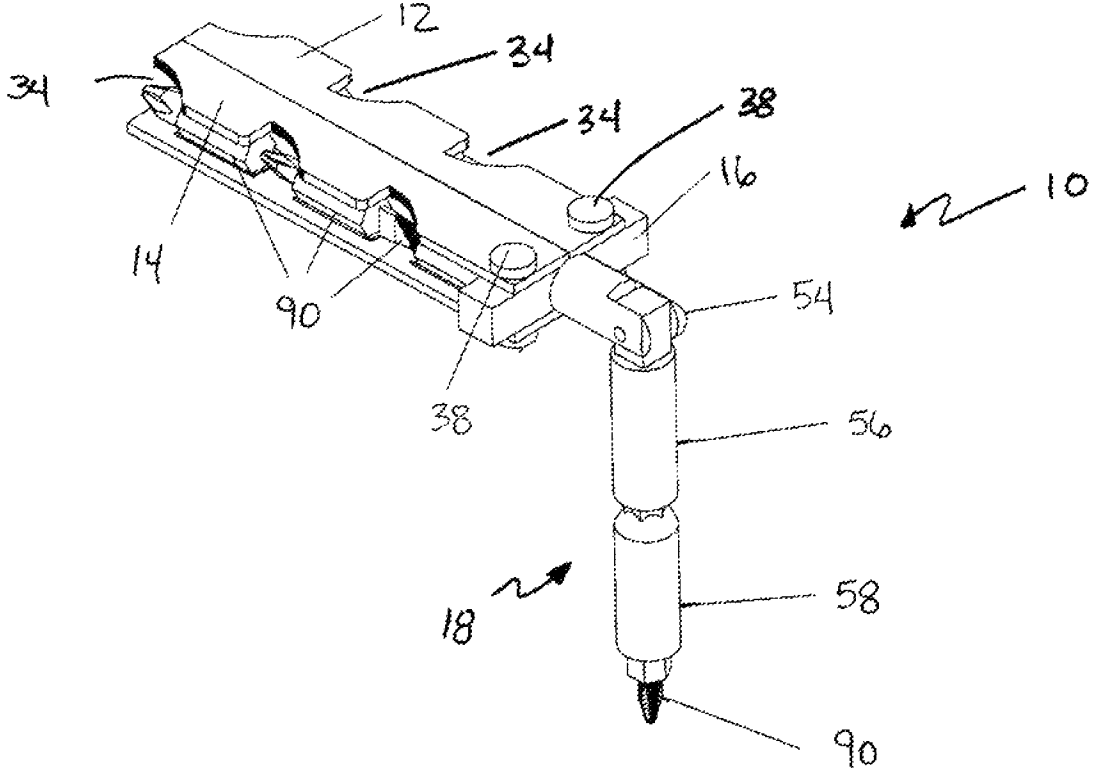
FIG. 2 is a perspective, top view of the tool illustrated in FIG. 1, with the shaft of the tool shown in an angled configuration, also consistent with the use of the invention.

The adjustment segment 56 permits the tool 10 to be manipulated from a linear (or straight) configuration or orientation, as illustrated in FIG. 1, to an angular orientation, as illustrated in FIG. 2. As may be appreciated, the linear orientation is consistent with the operation of a traditional screwdriver. The angular orientation may assist the user by providing additional leverage so that the user may apply additional torque to a particular fastener. The angular orientation also may permit a user to access a fastener in a difficult-to-reach location, for example.

The adjustment segment 56 also includes a retention member 76 therein. The retention member 76 is anticipated to be the same as the retention member 52 in the central protrusion 46. The retention member 76 is positioned to removably engage the extension member 58.

The extension segment 58 essentially is a cylindrical member that includes a first recess 78 in one end and a second recess 80 in the other end. As may be apparent, the extension segment 58 may be utilized to lengthen the shaft 18. As should be apparent, a plurality of extension segments 58 may be employed together to further extend the shaft 18, as needed or desired.

With respect to the extension segment 58, the first recess 78 engages the adjustment segment 56. In particular, the first recess 78 receives the retention member 76 so that the extension segment 58 is retained on the adjustment segment 56. The second recess 80 receives the bit driver segment 60 therein.

As also illustrated in FIG. 6, the extension segment 58 includes a magnet 82 therein. The magnet 82 extends from the first recess 78 to the second recess 80.

Since the various parts of the shaft 18 are contemplated to be made from a material including iron, it is anticipated that the segments will possess magnetic properties. As a result, with the inclusion of a magnet 82 in the extension segment 58, a magnetic attraction may be established between the adjustment segment 56 and the extension segment 58. This attraction is anticipated to enhance the connection between the adjustment segment 56 and the extension segment 58 to discourage inadvertent disconnection. The magnet 82 also is anticipated to provide an attraction between the extension segment 58 and the bit driver segment 60 so that the two segments remain in contact with one another.

With respect to the magnet 82, any suitable magnet may be employed without departing from the scope of the present invention. Given the size of the extension segment 58, however, it is contemplated that a high power magnet will be preferred. One such magnet may be a neodymium iron boride (NdFeB) magnet, for example. Such magnets are known in the art and are, therefore, not discussed further. As may be appreciated, however, any suitable magnet may be employed without departing from the scope of the present invention.

It is noted that the magnets 82, 88 are but one example of a suitable retention device that may be employed as a part of the tool 10 of the present invention. Other retention mechanisms include, but are not limited to, leaf springs, spring-biased ball bearings (like the retention members 52, 76), retaining springs, etc.

The bit driver segment 60 is essentially cylindrical member with a shaft 84 at one end and a recess 86 at the other. The shaft 84 is intended to be received in the second recess 80 in the extension segment 58. The recess 86 is intended to receive a bit 90 therein.

Just as with the extension segment 58, the bit driver segment 60 is contemplated to include a magnet 88 therein. The magnet 88 may be of the same type as the magnet 82. Alternatively, the magnets 82, 88 may differ from one another in their respective compositions and/or strengths without departing from the scope of the present invention. The magnet 88 is anticipated to provide an attractive force to keep the bit 90 in the recess 86. The magnet 88 also may supplement the magnetic attraction provided by the magnet 82.

As illustrated in FIG. 6, the central protrusion 46 is illustrated with a square cross-section. The recess 68, therefore, also is contemplated to have a square cross-section to receive the central projection 46. As should be immediately apparent, a square cross-sectional shape for the central projection 46 and the recess 68 is not required to practice the present invention. Any other suitable shape may be employed without departing from the scope of the present invention.

Similarly, the adjustment segment 56 is shown as having a square cross-sectional shape. The first recess 78 also is illustrated with a complimentary, square shape. As with the central protrusion 46 and the recess 68, the adjustment segment 56 and the first recess 78 need not have a square cross-sectional shape. Any other suitable shapes may be employed without departing from the scope of the present invention.

Regardless of the shape selected for the central protrusion 46 and the adjustment segment 56, it is contemplated that the two will present the same cross-sectional shapes. As such, it is contemplated that the attachment segment 54 may be removed altogether so that the first recess 78 may encompass the central protrusion 46 without the need for the attachment segment 54 and the adjustment segment 56. In this contemplated arrangement, therefore, the extension segment 58 would be connected directly to the driving member 16.

As also illustrated in FIG. 6, the second recess 80 in the extension segment 58 and the recess 86 in the bit driver segment 60 are hexagonal in shape. While any suitable shape for these recesses 80, 86 may be employed, a hexagonal shape is preferred so that the two segments 58, 60 may receive a bit 90 therein. It is contemplated that shapes other than hexagonal may be employed for tools 10 that are to be used with proprietary bits 90. As configured herein, the tool 10 is designed to accept standard bits 90, as should be appreciated by those skilled in the art.

Each of the bits 90 is anticipated to have a hexagonally-shaped end and a driving end. As discussed, the hexagonal ends are shaped to be received into either of the recesses 80, 86. The driving ends of the bits 90 may be configured to be received in any standard (or non-standard) fasteners.

As should be apparent to those skilled in the art, the bits 90 may have blade-shaped driving ends to be received in a standard screw. Alternatively, the driving ends of the bits may be plus-shaped to be receivable in Phillips head screws, for example. The driving ends of the bits 90 also may be provided with hex-shaped blades to be received in suitable Allen-type fasteners. A wide variety of shapes (as discussed in greater detail below) for the driving ends of the bits 90 may be employed, as should be apparent to those skilled in the art. The exact shape of the driving ends of the bits 90 is not critical to operation of the present invention. It is contemplated that the tool 10 will be provided with bits 90 having a variety of driving ends, at least in one embodiment.

It is noted that the tool 10 of the present invention is contemplated to be useable for any type of fastener, such as a screw. As should also be apparent to those skilled in the art, the tool 10 of the present invention may be configured to mate with recesses in components that are not fasteners. Given the breadth of such arrangements, further discussion is not provided herein.

Returning to FIG. 5, the tool 10 of the present invention also includes two bit carriages 92, 94. The bit carriages 92, 94 are positioned within the handle portions 12, 14. In one contemplated embodiment, the carriages 92, 94 are disposed removably within the handle portions 12, 14. In another contemplated embodiment, the carriages 92, 94 are fixed within the handle portions 12, 14 so that they cannot be removed therefrom.

Figure 8:
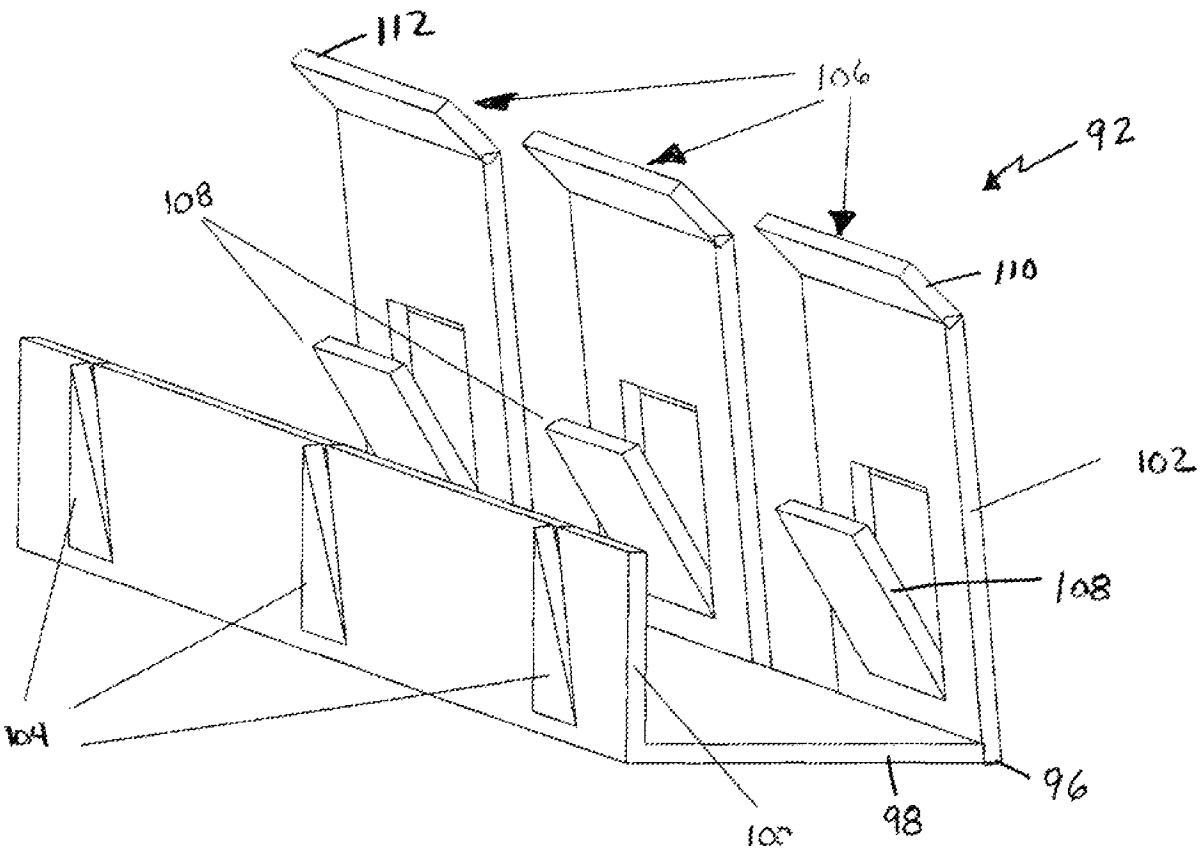
FIG. 8 is a perspective view of the bit gripping member (also referred to as a carriage), which is disposed in the handle portion of the tool illustrated in FIG. 1.
Figure 9:
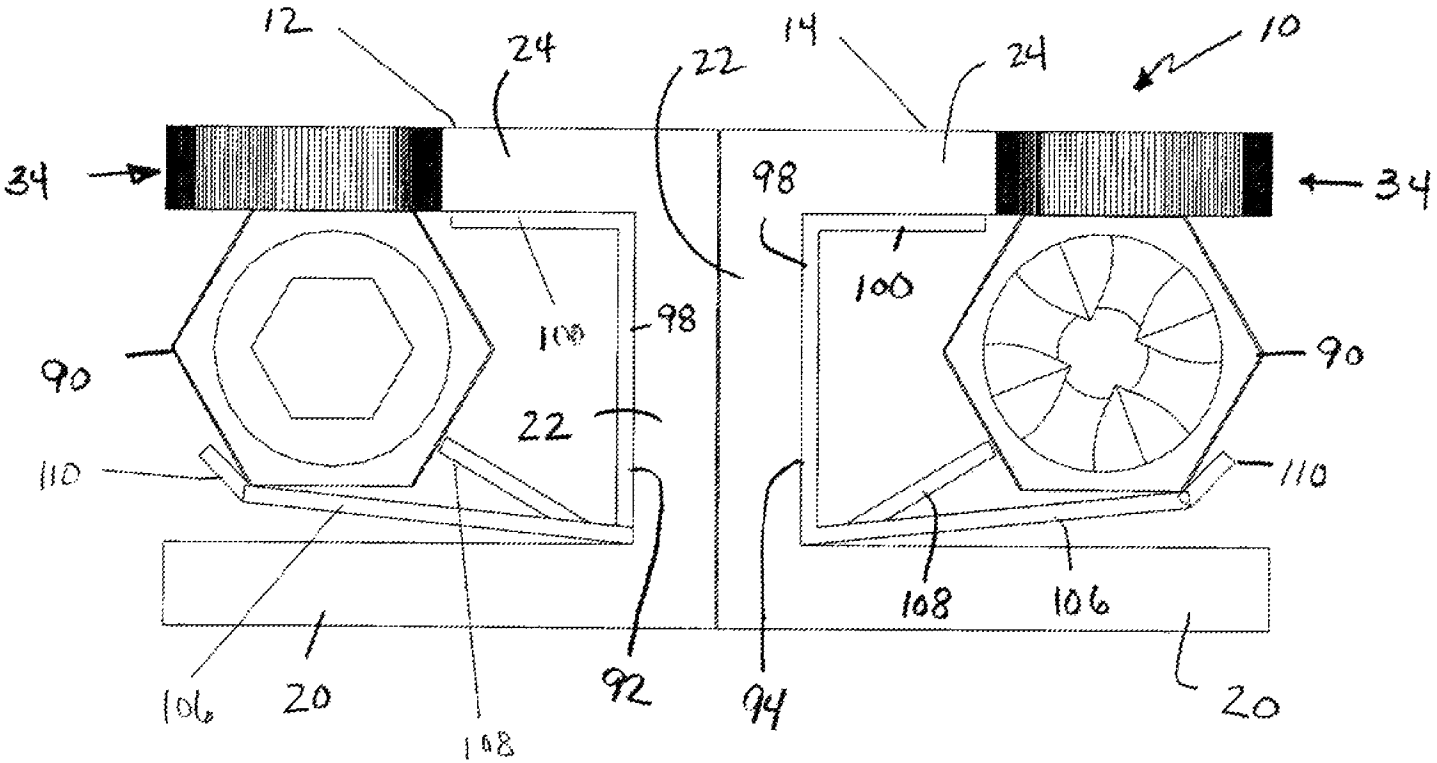
FIG. 9 is an end view of the tool illustrated in FIG. 1, showing the position of the bits within the handle portion of the tool.

Reference is now made to FIGS. 8 and 9, which illustrate the construction of the carriages 92, 94 in greater detail. As should be apparent from the drawings, the carriages 92, 94 share the same construction. Therefore, description of one of the carriages 92, 94 is intended to encompass both of the carriages 92, 94. For this reason, the carriage 92 will be discussed in connection with the depiction in FIG. 8.

The carriage 92, in its simplest form, has a U-shaped body 96 with a base 98, a first wall 100, and a second wall 102. The bits 90 are retained between the walls 100, 102 and the base 98.

In the illustrated embodiment, it is contemplated that the body 96 of the carriage 92 is made from a single sheet of metal that has been machined and folded into the U-shape shown. The metal may be of any type known to those skilled in the art. It is contemplated, however, that the metal will be an iron or aluminum-based alloy. It is also contemplated that the metal will be flexible, such as with spring steel. As should be appreciated by those skilled in the art, however, any other suitable material may be employed without departing from the scope of the present invention.

The first wall 100 has a rectangular shape with three tabs or barbs 104 protruding therefrom. When the carriage 92 is inserted into one of the handle portions 12, 14, the barbs 104 engage the interior surface of the top wall 24 of the handle portion 12, 14 to retain the carriage therewithin. In FIG. 9, the barbs 104 are not apparent, because they have been pressed into contact against the interior surfaces of the top walls 24.

The second wall 102 of the carriage 92 includes three flexible fingers 106. Each of the fingers 106 is provided with an inwardly-pointing tab 108. The fingers 106 each include an angled tip 110. The fingers 106, the tips 110, and the tabs 108 cooperate with one another to retain the bits 90 within the handle portion 12, 14. To understand how this is accomplished, reference is made to FIG. 9.

FIG. 9 illustrates the tool 10 of the present invention from an end view. As can be seen in FIG. 9, the first wall 100 abuts against the interior surfaces of the top side 24 of the respective handle portion 12, 14. The base 98 abuts against the interior surface of the lateral side 22 of the handle portion 12, 14. The fingers 106 are angled to extend inwardly from the interior surface of the bottom side 20 of the handle portions 12, 14. As also is apparent from FIG. 9, the first wall 100 of the carriage 92, 94 is shorter than the inward-most portion of the fin-shaped notches 34.

With this arrangement, a bit 90 may be inserted into the carriage 92, 94 in the handle portion 12, 14 by press-fitting the bit 90 so that it is frictionally engaged between the finger 106 and the interior surface of the top side 24 of the handle portion 12, 14. The fin-shaped notch 34 is provided to permit a user to remove the bit 90 from the carriage 92, 94 using the person's fingertips, for example. As illustrated, the tabs 108 help the position the bits 90 within respective positions within the carriage 92, 94 and help to prevent the bits 90 from sliding out of the ends of the carriage 92, 94.

As should be apparent to those skilled in the art, the carriages 92, 94 are illustrated as being capable of holding three bits 90 each. This construction is not required to practice the present invention. As should be apparent, a larger or smaller number of bits 90 may be retained in the carriages 92, 94, as desired.

As also should be apparent from the various figures of the drawings, the bits 90 are retained by the carriages 92, 94 in the handle portions in a fashion such that the axes of the bits 90 are aligned with one another. The axes of the bits 90 also are aligned with the main axis of the tool 10. It is for this reason, among others, that the tool 10 of the present invention presents such a small profile when in the closed orientation.

With renewed reference to FIGS. 1 and 3, the operation of the tool 10 of the present invention will now be discussed.

Figure 3:
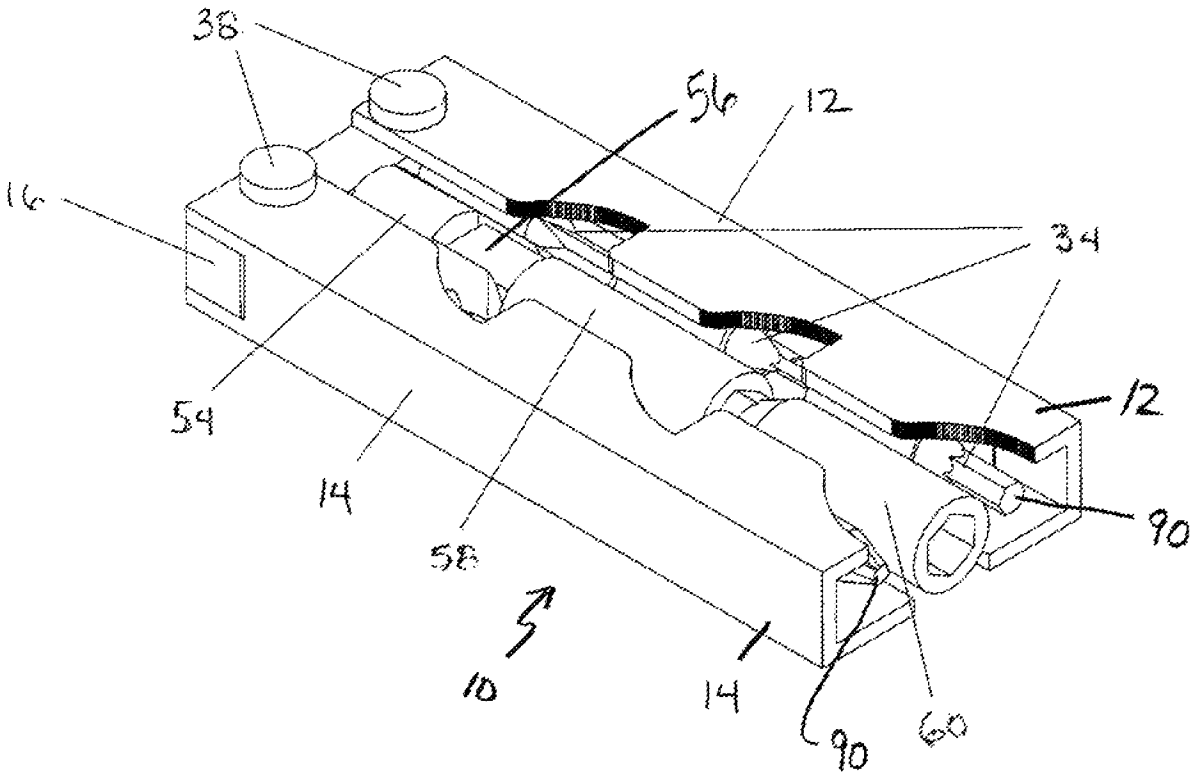
FIG. 3 is a perspective, top view of the tool illustrated in FIG. 1, shown in a folded state.
Figure 4:
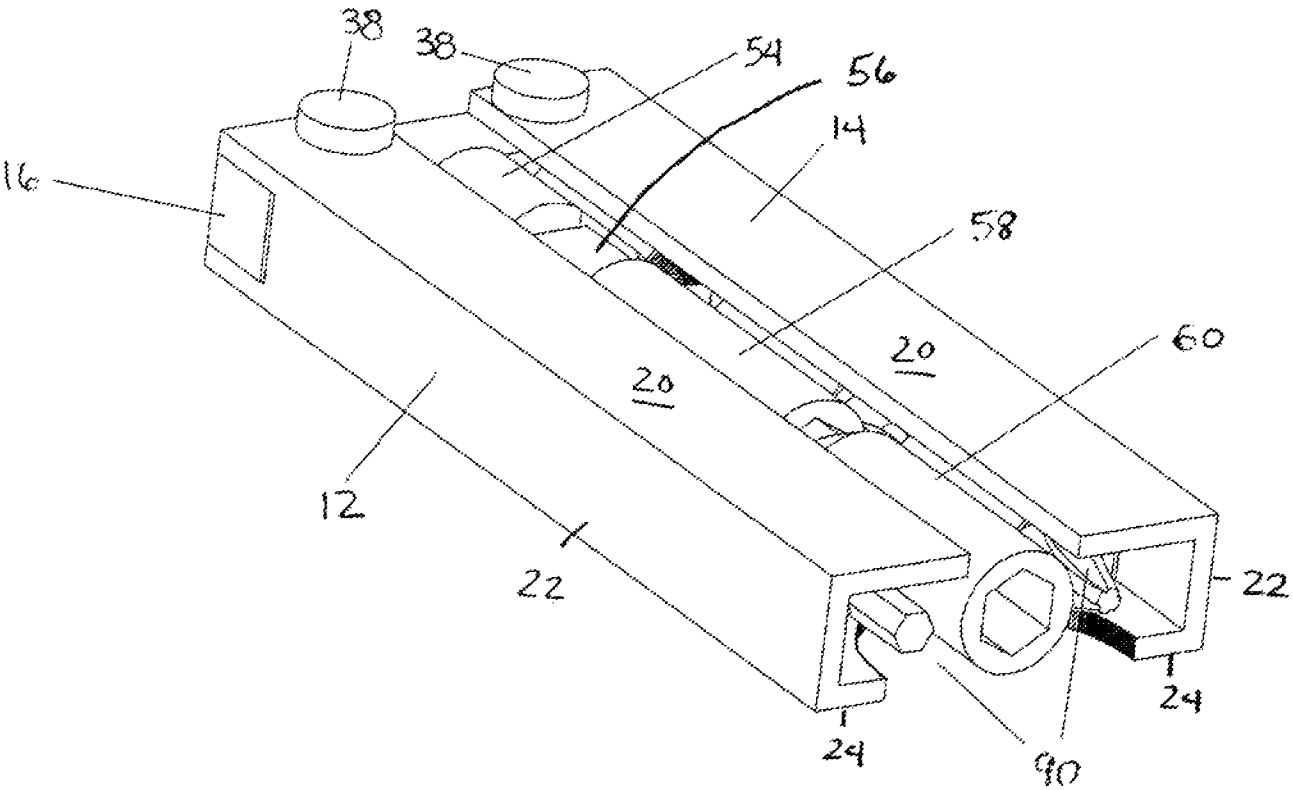
FIG. 4 is a perspective, bottom view of the tool illustrated in FIG. 1.

FIG. 3 shows the tool 10 in the collapsed or closed orientation. In this orientation, the tool 10 presents a minimal volumetric aspect, permitting the tool 10 to be carried easily in a user's pocket.

As also should be apparent, the bits 90 are disposed adjacent to the shaft 18 when the handle portions 12, 14 are in the closed orientation. This helps to prevent a loss of any one of the bits 90 when the tool 10 is in the closed orientation.

To use the tool 10, the user merely rotates the handle portions 12, 14 180 degrees from the closed orientation to the opened orientation. The lateral sides 22 of the handle portions 12, 14 will then meet with one another to present a unitary, graspable handle for the user. In addition, after being rotated to the opened position, the bits 90 that are stored in the carriages 92, 94 in the handle portions 12, 14 become accessible by the user. The user need only remove one of the bits 90 from the handle portions 12, 14 and place the bit 90 into the recess 86 in the bit driver segment 60, for example. If required, the user may change the orientation of the shaft into an angular orientation, as shown in FIG. 2.

To remove a bit 90 from its associated carriage 92, 94, the user inserts his or her fingertip into one of the fin-shaped recesses 34 and applies pressure to the selected bit 90. The finger 106 will be moved toward the bottom wall 20, allowing the bit 90 to be dislodged from its storage location. Once removed from the carriage 92, 94, the user may insert the bit into the bit driver segment 60 for use.

With respect to the bits 90, it is noted that each bit is anticipated to be about 1 inch (2.54 cm) in length. This is considered to be a standard size for bits 90 in the industry. As noted above, however, the present invention is not limited to bits of this particular size.

With respect to cooperation between the attachment segment 54 and the adjustment segment 56, it is contemplated that cooperation between these two elements will permit the user to adjust the angle of the shaft to a position 90 degrees from the axial orientation (i.e., the unadjusted position). Greater or lesser angular orientations also are contemplated to fall within the scope of the present invention. As noted, the ability to change the angular orientation of the shaft 18 permits the user to apply greater torque to the fastener. It also permits the user to work in tight spaces, as should be appreciated by those skilled in the art.

It is contemplated that the retention members 52, 76 will be incorporated into protrusions 46 or into adjustment segments 56 that include standard ¼ inch (0.64 cm) male drive ends. The corresponding recesses 68, 78 are contemplated to be standard ¼ inch (0.64 cm) female ends. As noted above, however, other sizes and configurations may be employed without departing from the scope of the present invention.

The construction of the retention members 52, 76 has been described above. With respect to these members 52, 76, it is understood that these members are manufactured as follows. First, a hole is bored into the associated structure, such as the central protrusion 46 or the adjustment segment 56. A spring and ball bearing are then press-fitted into the hole to be retained therein. Of course, as should be apparent to those skilled in the art, other methods of construction may be employed without departing from the scope of the present invention.

With respect to the magnets 82, 88, it is contemplated that the magnets 82, 88 are retained within the respective components via press-fitting. As should be apparent, however, the magnets 82, 88 may be affixed within the extension segment 58 or the bit driver segment 60 with a suitable adhesive. Other retention means also may be employed without departing from the scope of the present invention.

With respect to the carriages 92, 94, it is contemplated that these components will be manufactured from spring steel, as noted above. Any other material may be employed without departing from the scope of the present invention. It is contemplated, however, that the material for the carriages 92, 94 will have flexible characteristics to facilitate retention and release of the bits 90.

Concerning the fingers 106 that are incorporated into the carriages 92, 94, it is contemplated that the fingers 106 will be about ⅝ inch (1.6 cm) in width. Of course, any dimension may be employed without departing from the scope of the present invention.

Next, it is contemplated that the tabs 108 will be about ⅝ inch (1.6 cm) in length. Again, this dimension is provided as an example and is not meant to limit the scope of the present invention.

As noted above, one contemplated embodiment of the present invention includes a shaft 18 that is a single-piece construction. In this contemplated embodiment, the shaft 18 is not extensible nor can it be adjusted angularly, as can the shaft 18 of the tool 10. It is contemplated that this embodiment will be less expensive to manufacture since it will consist of a fewer number of components.

In another contemplated embodiment of the invention, a plurality of extension segments 58 may be provided, as discussed above. In addition, it is contemplated that one or more of the extension segments 58 may incorporate a ratchet device. Alternatively, a ratchet device may be incorporated at any position, and in any suitable segment of the shaft 18, as may be desired or required. Still further, a ratchet device may be incorporated into (or as a part of) the driving member 16.

Still further, it is contemplated that the tool 10 of the present invention may be constructed entirely (or partially) from non-conductive materials. If so, the tool 10 may be more suitably constructed for use in electrical environments where the tool 10 is anticipated to be used with or near components carrying an electrical current.

As noted above, the tool 10 is also not considered to be limited to two carriages 92, 94 and six bits. It is contemplated that a shorter version of the tool 10 may be constructed having a fewer number of bits. Alternatively, a longer version of the tool 10 may be manufactured to store a larger number of bits 90. A short version of the tool 10 may be suitable as an attachment to a key chain, for example. A longer version, which would hold more tool bits 90, might be desirable for industrial or construction work.

As noted above, the central protrusion 46 on the T-shaped driving member 16 is contemplated to be a standard ¼ inch (0.64 cm) male end. It is also contemplated that the protrusion 46 may have a ⅜ inch size (0.95 cm) or a ½ inch (1.25 cm) size, as may be suitable. The different sizes may be employed to accommodate a bit driver segment 60 with larger dimensions, for example.

Concerning the pins 38 and the caps 40, it is contemplated that one embodiment may incorporate bearings to facilitate opening of the handle portions 12, 14 of the tool 10. In still another contemplated embodiment, caromed bearings may be employed to bias the handle portions 12, 14 in either (or both) of the opened and closed orientations.

With respect to the attachment segment 54 and the adjustment segment 56, it is contemplated that these segments may be replaced with a suitable universal joint, if desired or required. Since these elements facilitate angular adjustment of the shaft 18, it is contemplated that camming mechanism may be incorporated into the flexible joint.

As noted above, one contemplated embodiment of the tool 10 of the present invention may incorporate multiple extension segments 58. In another contemplated embodiment, the shaft 18 may incorporate one or more standard shaft extenders, as would be understood by those skilled in the art. Standard shaft extenders include, but are not limited to, cylindrical shafts of various lengths.

One further embodiment contemplated for the tool 10 of the present invention incorporates a socket driver. In this embodiment, sockets may be directly attached to the protrusion 46 on the driving member 16 or to the adjustment segment 56.

It is noted that the shapes of the handle portions 12, 14, as discussed above, are not intended to be limiting of the present invention. Other shapes for the handle portions 12, 14 may be employed without departing from the scope of the present invention.

The configuration of the carriages 92, 94 also is not intended to be limiting of the present invention. It may be desirable to use different bit retaining devices to hold the bits 90 in the handle portions 12, 14. Alternative bit retaining devices include, but are not limited to, individual retaining clips for each bit 90, plastic or rubber inserts into which the bits 90 may be inserted, and individual magnets.

In connection with the bits 90 that are discussed above, a number of alternative embodiments are intended to be encompassed by the scope of the present invention. So as not to limit the present invention to any particular bit 90 or group of bits 90, the following additional examples are provided. As noted above, the present invention is not limited to any particular bit type. Besides the standard Phillips head, flat head (slotted), and hex head (Allen) drive bits, there are many other bits currently in use. Some of these bits are associated with unique applications. The Pozidriv is similar to the Phillips head but is designed not to cam out under torque as the Phillips head is. A variant of the Pozidriv is the Supadriv. The Supadriv and its associated screws may be used in applications where the tool cannot be aligned with the screw axis. Another variant of the Phillips head is the Frearson drive. It is used mainly for marine work and is designed not cam out as the Phillips head does. The JIS bit is another variant of the Phillips head. The JIS bit is designed not to cam out of its associated screw head and is used mainly in Japan. Other bit drivers that are specifically designed not to cam out are: the hex driver, the Torx driver, the square or Robertson driver, the spline driver, the triple square and the double hex. The Torx is found widely in the automotive and electronics industry while the Robertson (square) bit drive systems are used often in wood work.

Some of the drive types are specifically designed as security fasteners. Some of these are as follows. The security Torx is a Torx bit with a hole in the center of the driver to accommodate the pin in the center of the security Torx screw head. There are several variations of this type of screw head and its associated drivers in existence. The Tri-Wing system consists of three slots that meet in the center of the screw head. The one way clutch system prevents fastener removal. Its screw head and driver resemble a bow tie or butterfly depending upon the type. One way clutch drive systems are often used in the manufacture of mobile homes and recreational vehicles. The spanner head system has two holes in the fastener head and its associated driver has two pins that match the holes in the fastener head. These are commonly used in elevators. The TP3 drive system makes use of a triangular hole in the fastener head and has triangular faced driver.

Other driver types include Polydrive, the Torq-Set (similar to the Phillips) and the Bristol drive system. There are undoubtedly other proprietary fastener drivers in existence and undoubtedly there will be more as industry progresses. The described tool is useful for all the drive systems mentioned and will remain useful for new drive systems as they emerge.

As noted above, the various embodiments, variations, and equivalents that are discussed herein are intended to be exemplary of the present invention and are not intended to be limiting thereof. Other equivalents and variations should be apparent to those skilled in the art. Those variations and equivalents are intended to be encompassed by the present invention.

What is claimed is:

1. A tool, comprising:

a driving member comprising a protrusion;

a shaft removably connectable to the protrusion, wherein the shaft includes at least a bit driving segment for retention of a bit therein, the bit being engageable at least with a complimentary fastener;

a handle comprising a first handle portion and a second handle portion, wherein the first and second handle portions are pivotally connected to the driving member such that the first and second handle portions at least partially encompass the shaft when in a closed position, and wherein the first and second handle portions abut one another when in an opened position, thereby presenting a unified handle for driving the shaft;

at least one bit retention member disposed in at least one of the handle portions, wherein the bit retention member retains at least one bit therein, the bit being insertable into the bit driving segment; and at least one notch fashioned into said at least one of the handle portions, the at least one notch being in register with the at least one bit retention member, permitting a user to access the at least one bit retained therein.

2. The tool of claim 1, wherein the driving member comprises:

a T-shaped body with a first arm, a second arm opposing the first arm, and the protrusion disposed therebetween and extending perpendicularly therefrom.

3. The tool of claim 2, wherein the protrusion includes a retention member therein that comprises a ball bearing biased in a distended position by a spring.

4. The tool of claim 2, wherein the driving member further comprises:

a first opening in the first arm;

a first pin disposed within the first opening to pivotally support the first handle portion on the first arm;

a second opening in the second arm; and a second pin disposed within the second opening to pivotally support the second handle portion of the second arm.

5. The tool of claim 1, wherein the shaft comprises:

at least one attachment segment that removably engages with the protrusion; and at least one adjustment segment that permits the shaft to be angled with respect to an axis of the protrusion;

wherein the bit driving segment removably connects to the at least one adjustment segment.

6. The tool of claim 5, further comprising:

an extension segment disposable between the at least one adjustment segment and the bit driving segment, wherein the extension segment extends a length of the shaft.

7. The tool of claim 6, further comprising:

a first magnet disposed within the at least one extension segment to provide a magnetic attraction between the at least one extension segment and the bit driving segment.

8. The tool of claim 7, further comprising:

a second magnet disposed within the bit driving segment to provide a magnetic force at least between the bit driving segment and the bit.

9. The tool of claim 1, wherein the first handle portion and the second handle portion comprise:

a top wall, a lateral wall, and a bottom wall connected to one another to form a U-shaped body, the at least one notch being fashioned into the top wall, wherein the first handle portion is a mirror image of the second handle portion.

10. The tool of claim 1, wherein the at least one bit retention member comprises:

a U-shaped body that is insertable into said at least one of the first and second handle portions, the U-shaped body of the at least one bit retention member comprising a base, a first wall, and a second wall that form a channel within the U-shaped body.

11. The tool of claim 10, wherein the first wall comprises at least one barb to assist with retaining the at least one bit retention member in at least one of the first and second handle portions and the second wall comprises at least one finger, with an angled tip, and a tab extending into the channel.

12. The tool of claim 11, wherein the tab, the at least one finger, and an interior surface of the top wall of at least one of the first and second handle portions cooperate to retain the bit therein.

13. The tool of claim 1, wherein an axis of the at least one bit, when stored in the at least one bit retention member, is parallel with an axis of the shaft when the first and second handle portions are in the closed position.

14. The tool of claim 13, wherein an axis of the at least one bit, when stored in the at least one bit retention member, is parallel with an axis of the shaft when the first and second handle portions are in the opened position.

15. A tool, comprising:

a driving member comprising a protrusion;

a shaft removably connectable to the protrusion, wherein the shaft includes at least a bit driving segment for retention of a bit therein, the bit being engageable at least with a complimentary fastener;

a handle comprising a first handle portion and a second handle portion, wherein the first and second handle portions are pivotally connected to the driving member such that the first and second handle portions at least partially encompass the shaft when in a closed position, and wherein the first and second handle portions abut one another when in an opened position, thereby presenting a unified handle for driving the shaft; and at least one bit retention member disposed in at least one of the handle portions, wherein the bit retention member retains at least one bit therein, the bit being insertable into the bit driving segment;

wherein an axis of the at least one bit, when stored in the at least one bit retention member, is parallel with an axis of the shaft when the first and second handle portions are in the closed position.

16. The tool of claim 15, wherein an axis of the at least one bit, when stored in the at least one bit retention member, is parallel with an axis of the shaft when the first and second handle portions are in the opened position.

17. The tool of claim 15, further comprising:

at least one notch fashioned into said at least one of the handle portions, the at least one notch being in register with the at least one bit retention member, permitting a user to access the at least one bit retained therein.

18. The tool of claim 15, wherein the shaft comprises:

at least one attachment segment that removably engages with the protrusion; and at least one adjustment segment that permits the shaft to be angled with respect to an axis of the protrusion;

wherein the bit driving segment removably connects to the at least one adjustment segment.

19. The tool of claim 18, further comprising:

an extension segment disposable between the at least one adjustment segment and the bit driving segment, wherein the extension segment extends a length of the shaft.

20. The tool of claim 19, further comprising:

a first magnet disposed within the at least one extension segment to provide a magnetic attraction between the at least one extension segment and the bit driving segment.

* * * * *